US006364477B1

(12) United States Patent
Missell et al.

(10) Patent No.: US 6,364,477 B1
(45) **Date of Patent: *Apr. 2, 2002**

(54) INK JET RECORDING ELEMENT CONTAINING POLYMERIC PARTICLES

(75) Inventors: Gregory E. Missell, Penfield; Dennis E. Smith, Rochester; John L. Muehlbauer, Stafford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/458,401

(22) Filed: Dec. 10, 1999

(51) Int. Cl.[7] ..... B41J 2/01
(52) U.S. Cl. ..... 347/105
(58) Field of Search ..... 347/100, 91, 105, 347/95; 428/411.1

(56) References Cited

U.S. PATENT DOCUMENTS

| | | | | | |
|---|---|---|---|---|---|
| 3,958,995 | A | * | 5/1976 | Campbell et al. | 96/84 |
| 5,418,078 | A | * | 5/1995 | Desie et al. | 428/704 |
| 5,789,070 | A | * | 8/1998 | Shaw-Klein et al. | 428/216 |
| 6,045,917 | A | * | 4/2000 | Missell et al. | 428/411.1 |
| 6,299,303 | B1 | * | 10/2001 | Wexler | 347/105 |

* cited by examiner

*Primary Examiner*—Michael P. Nghiem
(74) *Attorney, Agent, or Firm*—Harold E. Cole

(57) ABSTRACT

An ink jet recording element including a support having thereon, in the order recited, a base layer including a hydrophilic material and a non-porous, ink-receptive top layer including a binder, mordant and polymeric particles, the particles having a particle size of less than about 0.5 $\mu$m and being present in an amount of from about 20 to about 50% by weight of the ink-receptive top layer.

17 Claims, No Drawings

INK JET RECORDING ELEMENT CONTAINING POLYMERIC PARTICLES

CROSS REFERENCE TO RELATED APPLICATION

Reference is made to commonly-assigned, U.S. patent application Ser. No. 09/114,022, filed Jul. 10, 1998, now U.S. Pat. No. 6,045,917.

FIELD OF THE INVENTION

This invention relates to an ink jet recording element, more particularly to an inkjet recording element which contains particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Exhibit the ability to absorb high concentrations of ink and dry quickly to avoid elements blocking together when stacked against subsequent prints or other surfaces
- Provide a high level of gloss and avoid differential gloss
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light U.S. Pat. No. 5,027,131 relates to an ink jet recording element comprising a support having thereon an ink-retaining layer and an ink transporting layer. The ink transporting layer is porous and contains particles in a large amount. This layer is designed to allow ink to be transported through it to the ink retaining-layer. However, there is a problem with this element in that it is a reverse-viewing element. In other words, the support has to be transparent in order to view the image through it. Opaque supports such as paper are therefore excluded by this technique.

EP 0 888 902 relates to an ink jet recording element comprising an ink sorptive layer which contains up to 15% by weight of polymer particles. However, there is a problem with this element in that the surface layer is not smooth and scatters light.

It is an object of this invention to provide an ink jet recording element which does not require a transparent support. It is another object of this invention to provide an ink jet recording element that has a glossy surface. It is another object of this invention to provide an ink jet recording element that has an improved waterfastness.

SUMMARY OF THE INVENTION

This and other objects are provided by the present invention comprising an ink jet recording element comprising a support having thereon, in the order recited, a base layer comprising a hydrophilic material and a non-porous, ink-receptive top layer comprising a binder, mordant and polymeric particles, the particles having a particle size of less than about 0.5 $\mu$m and being present in an amount of from about 20 to about 50% by weight of the ink-receptive top layer.

Another embodiment of the invention relates to an ink jet printing process comprising:

a) providing an ink jet recording element as described above, and b) applying liquid ink droplets thereon in an image-wise manner.

By use of the invention, ink jet recording elements are obtained which do not require a transparent support, have a glossy surface and improved waterfastness.

DETAILED DESCRIPTION OF THE INVENTION

The polymeric particles useful in the top layer of the ink jet recording element of the invention may be made from virtually any polymer and can be synthesized, for example; from the following monomers: alkyl esters of acrylic or methacrylic acid such as methyl methacrylate, ethyl methacrylate, butyl methacrylate; the hydroxyalkyl esters of the same acids such as 2-hydroxyethyl acrylate, and the nitrile and amides of the same acids such as acrylonitrile, methacrylonitrile, and butyl acrylamide, vinyl acetate, vinylidene chloride, vinyl chloride, and vinyl aromatic compounds such as styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the polymeric particles are polyfunctional with respect to the polymerization reaction, and may include, for example, esters of unsaturated monohydric alcohols with unsaturated monocarboxylic acids, such as allyl methacrylate, and vinyl methacrylate, esters of saturated glycols or diols with unsaturated monocarboxylic acids, such as ethylene glycol diacrylate, ethylene glycol dimethacrylate, and polyfunctional aromatic compounds such as divinyl benzene.

In a preferred embodiment of the invention, the polymeric particles are made from acrylic or styrenic monomers, such as poly(methyl methacrylate) or polystyrene. In another preferred embodiment, the polymeric particles are crosslinked.

Following are examples of polymeric particles which may be used in the invention:

| Particle | Polymer | Particle Size (μm) |
|---|---|---|
| P-1 | Poly(methyl methacrylate) | 0.107 |
| P-2 | Polystyrene | 0.110 |
| P-3 | Poly(methyl methacrylate-co-ethyleneglycol dimethacrylate) | 0.142 |

The addition of the mordant to the top layer does not degrade other performance features such as dry time, lightfastness, coalescence, bleeding, adhesion of the layers, waterfastness, and gloss when printed with a variety of ink jet inks.

Preferred mordant polymers used in the invention comprise units having the formula:

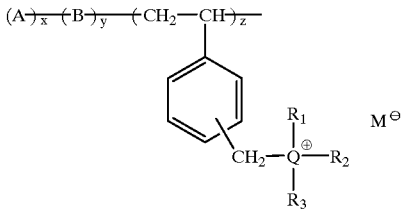

wherein:

A represents units of an addition polymerizable monomer containing at least two ethylenically unsaturated groups;

B represents units of a copolymerizable, α,β-ethylenically unsaturated monomer;

Q is nitrogen or phosphorous;

$R_1$, $R_2$ and $R_3$ each independently represents a carbocyclic or alkyl group;

$M^-$ is an anion;

x is from about 0.25 to about 5 mole percent;

y is from about 0 to about 90 mole percent; and z is from about 10 to about 99 mole percent.

In a preferred embodiment of the invention, A is a repeating unit of an addition polymerizable monomer containing at least two ethylenically unsaturated groups, such as vinyl groups generally having the following structure:

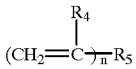

wherein:

n is from 1 to about 10, preferably 2 or 3;

each $R_4$ independently represents hydrogen or methyl; and $R_5$ is a linking group comprising one or more condensation linkages such as amide, sulfonamide, esters such as sulfonic acid ester, arylene etc., or a condensation linkage and an organic nucleus such as alkylene, e.g., methylene, ethylene, trimethylene, arylene, etc.

Suitable monomers from which the repeating units of A are formed include divinylbenzene, allyl acrylate, allyl methacrylate, N-allylmethacrylamide, etc.

B in the above formula is a unit of a copolymerizable α,β-ethylenically unsaturated monomer (including two, three or more repeating units), such as ethylene, propylene, 1-butene, isobutene, 2-methylpentene, etc. A preferred class of ethylenically unsaturated monomers which may be used include the lower 1-alkenes having from 1 to about 6 carbon atoms; styrene, and tetramethylbutadiene and methyl methacrylate.

$R_1$, $R_2$ and $R_3$ in the above formula each independently represents a carbocyclic group such as aryl, aralkyl, and cycloalkyl such as benzyl, phenyl, p-methyl-benzyl, cyclohexyl, cyclopentyl, etc.; or an alkyl group preferably containing from 1 to about 20 carbon atoms such as methyl, ethyl, propyl, isobutyl, pentyl, hexyl, heptyl, decyl, etc. In a preferred embodiment, $R_1$, and $R_2$ are each methyl, $R_3$ is benzyl, Q is nitrogen, A is divinylbenzene, and B is styrene.

$M^-$ in the above formula is an anion, i.e., a negative salt forming an ionic radical or atom such as a halide, e.g., bromide or chloride, sulfate, alkyl sulfate, alkane or arene sulfonate, acetate, phosphate, etc.

Further examples of the mordant polymers useful in the invention and preparation of the above polymers are found in U.S. Pat. No. 3,958,995, the disclosure of which is hereby incorporated by reference. Specific examples of the major components of such mordant polymers include the following:

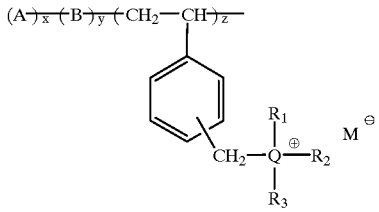

| Mordant | A | B | $R_1$ | $R_2$ | $R_3$ |
|---|---|---|---|---|---|
| 1 | $C_6H_4(CH{=}CH_2)_2$ | $C_6H_5{-}CH{=}CH_2$ | $CH_3$ | $CH_3$ | $CH_2C_6H_5$ |
| 2 | $C_6H_4(CH{=}CH_2)_2$ | $C_6H_5{-}CH{=}CH_2$ | $CH_3$ | $CH_3$ | $CH_3$ |
| 3 | $C_6H_4(CH{=}CH_2)_2$ | $C_6H_5{-}CH{=}CH_2$ | $CH_3$ | $CH_3$ | $(CH_3)_2{-}CHCH_2$ |
| 4 | $C_6H_4(CH{=}CH_2)_2$ | $C_6H_5{-}CH{=}CH_2$ | $(CH_3)_2{-}CHCH_2$ | $(CH_3)_2{-}CHCH_2$ | $(CH_3)_2{-}CHCH_2OH$ |

-continued

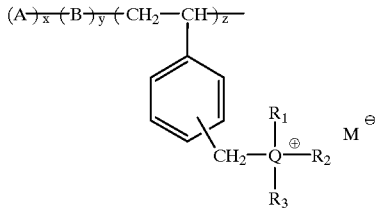

| Mordant | A | B | $R_1$ | $R_2$ | $R_3$ |
|---|---|---|---|---|---|
| 5 | $C_6H_4(CH{=}CH_2)_2$ | $H_2C{=}C(CH_3)$ $CO_2{-}CH_3$ | $CH_3$ | $CH_3$ | $CH_2C_6H_5{-}$ OH |
| 6 | $(H_2C{=}C(CH_3){-}$ $CO_2CH_2)_2$ | $H_2C{=}C(CH_3)$ $CO_2{-}CH_3$ | $CH_3$ | $CH_3$ | $CH_2C_6H_5$ |

The mordant in the top layer may be used in any amount effective for intended purpose. In general, good results have been obtained when the mordant polymer is present in an amount of about 5% to about 25% by weight of the top layer, preferably about 10%.

Binders useful in the top layer of the recording element of the invention include nonionic cellulose ethers, anionic cellulose ethers, polyvinyl alcohol, sulfonated polyesters, polyvinylpyrrolidone, methyl cellulose, e.g., A4M (Dow Chemical Co.) and hydroxyethyl cellulose, such as JR400 (hydroxyethyl cellulose reacted with a trimethyl ammonium chloride substituted epoxide from Amerchol Corp.) in a weight ratio of 80/20. These materials may be used in amounts from about 0.75 g/m$^2$ to about 1.25 g/m$^2$, preferably from about 1 g/m$^2$ to about 1.1 g/m$^2$. The top layer generally has a thickness of about 0.1 to about 2.0 $\mu$m.

In a preferred embodiment of the invention, the binder is a hydroxyethyl cellulose cationically-modified cellulose ether. In another preferred embodiment, the cationically modified cellulose ether is a hydroxyethyl cellulose reacted with trimethylammonium chloride substituted epoxide or hydroxyethyl cellulose reacted with a dodecyl dimethylammonium chloride substituted epoxide, as described in copending Ser. No. 08/763,808, of Shaw-Klein et al., filed Dec. 11, 1996.

The top layer may contain about 5 to about 75 weight percent of the cationically-modified cellulose ether described above. Useful cationically-modified cellulose ether polymers include Celquat® SC240C (hydroxyethyl cellulose reacted with trimethylammonium chloride substituted epoxide from National Starch and Chemical Co.) and Quatrisoft® LM-200 (hydroxyethyl cellulose reacted with a dodecyl dimethylammonium chloride substituted epoxide from Amerchol Corp.).

The base layer is primarily intended to act as a sponge layer for the absorption of ink solvent. As such, it is primarily composed of hydrophilic or porous materials. Generally, the base layer has a thickness of about 3 to about 20 Jim, and is present in an amount from about 5 g/m$^2$ to about 7 g/m$^2$, preferably from about 5.3 g/m$^2$ to about 5.5 g/m$^2$. Suitable hydrophilic materials include gelatin, acetylated gelatin, phthalated gelatin, oxidized gelatin, chitosan, poly(alkylene oxide), poly(vinyl alcohol), modified poly (vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), or polyacrylamide or mixtures thereof. Copolymers of these polymers with hydrophobic monomers may also be used.

The pH of the base layer may be adjusted to optimize swelling (water capacity), to enhance gloss or to minimize dye migration. For example, the pH of the layer may be reduced to 3.5 to improve swelling capacity, thereby reducing ink drying times, and to impart waterfastness. In another embodiment, the pH of the image recording layer may be raised to 8.5 in order to enhance gloss and reduce bronzing due to surface dye crystallization.

In a preferred embodiment of the invention, the base layer is 50%–100% photographic-grade gelatin, modified so that the pH is far from the isoelectric point of the gelatin, so that water uptake may be maximized. The remainder of the layer may consist of a polymer or inorganic material compatible with the gelatin which does not adversely impact functional properties.

If desired, the base layer of the recording element of the invention may be made porous by the addition of ceramic or hard polymeric particulates, by foaming or blowing during coating, or by inducing phase separation in the layer through introduction of a nonsolvent. In addition, rigidity may be imparted to the base layer through incorporation of a second phase such as polyesters, poly(methacrylates), polyvinyl benzene- containing copolymers and the like.

In the present invention, the recording element can be opaque, translucent, or transparent. Thus, the supports utilized in the recording element of the present invention are not particularly limited and various supports may be employed. Accordingly, plain papers, resin-coated papers, various plastics including a polyester-type resin such as poly(ethylene terephthalate), poly(ethylene naphthalate) and polyester diacetate, a polycarbonate-type resin, a fluorine-type resin such as polytetrafluoroethylene, metal foil, various glass materials, and the like can be employed as supports. When the supports of the present invention are transparent, a transparent recording element can be obtained and used as a transparency in an overhead projector. The thickness of the support employed in the invention can be from about 12 to about 500 $\mu$m, preferably from about 75 to about 300 $\mu$m.

If desired, in order to improve the adhesion of the base layer to the support, the surface of the support may be corona-discharge-treated prior to applying the base layer or solvent-absorbing layer to the support. Alternatively, an under-coating, such as a layer formed from a halogenated phenol or a partially hydrolyzed vinyl chloride-vinyl acetate copolymer can be applied to the surface of the support.

Since the image recording element may come in contact with other image recording articles or the drive or transport mechanisms of image recording devices, additives such as surfactants, lubricants, matte particles and the like may be added to the element to the extent that they do not degrade the properties of interest.

The layers described above, including the base layer and the top layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of both layers, which is preferred from a manufacturing economic perspective.

Ink jet inks used to image the recording elements of the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples further illustrates the invention.

EXAMPLES

Synthesis of Polymer Particles

Preparation of P-1

To a beaker are added the following ingredients: 500 g methyl methacrylate, 13.5 g Aerosol OT-100® (dioctyl ester of sodium sulfosuccinic acid), 9.4 g hexadecane, and 7.5 g 2,2'-azobis(2,4-dimethylvaleronitrile) sold by DuPont under the trade name Vazo 52®. The ingredients are stirred until all the solids are dissolved. This solution is added to 820 g distilled water and stirred with a marine prop type agitator for 5 minutes. The mixture is passed through a Crepaco homogenizer operated at 350 kg/cm$^2$ (5000 psi) to form the final droplet size. Then, 1268 g of the droplet dispersion is poured into a 3 liter round bottom flask and 720 g distilled water is added. The flask in then placed into a constant temperature bath at 52° C. and stirred at 100 RPM for 16 hours.

Preparation of P-2

This preparation is the same as P-1 except that styrene was used instead of methyl methacrylate, the solution was added to 1576 g of distilled water instead of 820 g and the homogenized droplet dispersion was put into the constant temperature bath without adding additional distilled water.

Preparation of P-3

This preparation is the same as P-2 except that a mixture of 400 g of methyl methacrylate and 100 g of ethylene glycol dimethacrylate was used instead of styrene.

Preparation of Control Particles

To a beaker are added the following ingredients: 490.6 g methyl methacrylate, 9.4 g divinylbenzene, 13.8 g Aerosol OT-100® (dioctyl ester of sodium sulfosuccinic, acid), and 5 g lauroyl peroxide. The ingredients are stirred until all the solids are dissolved. This solution is added to 1553 g distilled water and stirred with a marine prop type agitator for 5 minutes. The mixture is passed through a Gaulin mill operated at 3600 RPM, 0.25 mm gap and feed at 3.8 kg per minute to form the final droplet size. The droplet dispersion is poured into a 3 liter round bottom flask and placed into a constant temperature bath at 60° C. and stirred at 100 RPM for 16 hours. The particles prepared by this process are 0.65 $\mu$m in size as measured by a LA-920 particle size analyzer (Horiba Instruments Inc.)

Control Element 1—(No Polymer Particles)

This recording element was prepared by slot coating. The base layer was coated from a 10% solids aqueous formulation directly on corona discharge-treated, photographic grade, polyethylene-coated paper and dried thoroughly at 100° C. The final dry coverage of the base layer was 5.4 g/m$^2$. The image recording layer (top layer) was coated directly over the base layer in a second pass from coating formulations ranging from 1 to 2% solids. The latter layer was dried under identical conditions to the base layer. The dry coverage of the image receiving layer (top layer) was 1.1 g/m$^2$.

The base layer of the element was a mixture of 75% by weight lime-process ossein photographic grade gelatin, 15% polyvinylpyrrolidone (PVP K-90, ISP) and 10% by weight of mordant 1 illustrated above where x=1 mole %, y=49.5 mole % and z=49.5 mole %. The pH of the coating formulation was adjusted to 3.5 by direct addition of hydrochloric acid (36–38%, JT Baker).

The top layer of the element was a 35/50/15% mixture of methyl cellulose (A4M) (Dow Chemical Co.), hydroxyethyl cellulose (Quatrisoft® LM200, Amerchol Corp.) and mordant 1 illustrated above where x=1 mole %, y=49.5 mole % and z=49.5 mole %.

Control Element 2—(Control Polymer Particles-0.65 $\mu$m)

This element was the same as C-1 except that the top layer contained the above-described Control Particles (0.65 $\mu$m) at 30% by weight.

Control Element 3—P-1 Polymer Particles at 10%)

This element was the same as C-1 except that top layer contained the above-described P-1 Particles at 10% by weight.

Control Element 4—(P-1 Polymer Particles at 60%)

This element was the same as C-1 except that top layer contained the above-described P-1 Particles at 60% by weight.

Element 1—Invention (P-1 Polymer Particles at 20%)

This element was the same as C-1 except that top layer contained the above-described P-1 Particles at 20% by weight.

Element 2—Invention (P-1 Polymer Particles at 30%)

This element was the same as C-1 except that top layer contained the above-described P-1 Particles at 30% by weight.

Element 3—Invention (P-1 Polymer Particles at 40%)

This element was the same as C-1 except that top layer contained the above-described P-1 Particles at 40% by weight.

Element 4—Invention (P-2 Polymer Particles at 30%)

This element was the same as C-1 except that top layer contained the above-described P-2 Particles at 30% by weight.

Element 5—Invention (P-3 Polymer Particles at 30%)

This element was the same as C-1 except that top layer contained the above-described P-3 Particles at 30% by weight.

Printing

Each element was then imaged on a Lexmark 5700 Ink Jet Printer at 118×236 dots per cm (300×600 dpi) with Lexmark Photo Inks, cyan, magenta and yellow (U.S. Pat. Nos. 5,364,461; 5,254,160 and 5,497,178). These elements were air dried for 12 hours and then subjected to various tests as follows:

5-Minute Soak Test

The density of each solid color patch (cyan, magenta, yellow, red, green blue, black) was then read using an X-Rite 820® densitometer. The image was then submerged under distilled water at 22° C. and placed in a wave pan from VWR Scientific. The imaged was subjected to the slow wave motion for 5 minutes. The image was removed and allowed to air dry 12 hours. The density was reread and the change in density was calculated for each color and then the average change was calculated. The smaller the change in density the better the waterfastness.

The top layer of the coating was observed to see if it delaminated or "washed" off during the 5 minute soak test. A rating from 1 to 5 was given where 1 represents no delamination and 5 represents where the top layer completely washed off. A rating of 4 or 5 is not acceptable.

Raindrop Test

Three drops of distilled water at 22° C. were placed on each solid color patch of the imaged element. After 30 minutes, the images were rated for any damage to the image. A rating of 1 to 5 was used where 1 represents no damage and a 5 rating represents severe damage. Damage is defined as top layer cracking, density loss, watermarks, loss of gloss, or surface changes. A rating of 4 or 5 is not acceptable.

Gloss

Each color patch of the imaged elements was measured for 60-degree gloss using a Gardner Gloss Meter. The average gloss was calculated. The control element of C-1, which has no polymer particles, had an average gloss of 75. If the average gloss was reduced by more than 10 units to 65 or less, it was not acceptable.

The following results were obtained:

| | 5-Minute Soak Test | | | |
|---|---|---|---|---|
| Element | Density Change (%) | Delamination | Raindrop | Gloss |
| C-1 | −54 | 5 | 5 | 75 |
| C-2 | −27 | 3 | 2 | 39 |
| C-3 | +5 | 4 | 4 | 71 |
| C-4 | −2 | 2 | 2 | 59 |
| I-1 | 0 | 2 | 1 | 74 |
| I-2 | −1 | 2 | 1 | 72 |
| I-3 | −1 | 2 | 1 | 70 |
| I-4 | −10 | 3 | 2 | 68 |
| I-5 | −9 | 2 | 2 | 77 |

The above results show that C-1 had a large density change and failed the delamination and raindrop tests, C-2 had a significant density change and very low gloss, C-3 failed the delamination and raindrop tests and C-4 had low gloss. In contrast to the control elements, the elements of the invention had acceptable density changes, passed the delamination and raindrop tests and maintained good gloss.

This invention has been described with particular reference to preferred embodiments thereof but it will be understood that modifications can be made within the spirit and scope of the invention.

What is claimed is:

1. An ink jet recording element comprising a support having thereon, in the order recited, a base layer comprising a hydrophilic material and a non-porous, ink-receptive top layer comprising a binder, mordant and polymeric particles, said particles having a particle size of less than about 0.5 $\mu$m and being present in an amount of from about 20 to about 50% by weight of said ink-receptive top layer.

2. The ink jet recording element of claim 1 wherein said polymeric particles are made from acrylic or styrenic monomers.

3. The ink jet recording element of claim 2 wherein said polymeric particles are made from poly(methyl methacrylate) or polystyrene.

4. The ink jet recording element of claim 2 wherein said polymeric particles are crosslinked.

5. The ink jet recording element of claim 1 wherein said mordant has the following formula:

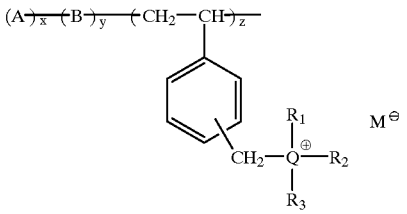

wherein:

A represents units of an addition polymerizable monomer containing at least two ethylenically unsaturated groups;

B represents units of a copolymerizable, α,β-ethylenically unsaturated monomer;

Q is nitrogen or phosphorous;

$R_1$, $R_2$ and $R_3$ each independently represents a carbocyclic or alkyl group;

$M^-$ is an anion;

x is from about 0.25 to about 5 mole percent;

y is from about 0 to about 90 mole percent; and z is from about 10 to about 99 mole percent.

6. The element of claim 5 wherein A is a repeating unit of an addition polymerizable monomer containing at least two ethylenically unsaturated groups having the following structure:

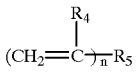

wherein n is an integer from 1 to about 10; each $R_4$ independently represents hydrogen or methyl; and $R_5$ is a linking group comprising one or more condensation linkages.

7. The element of claim 5 wherein $R_1$ and $R_2$ are each methyl, $R_3$ is benzyl, Q is nitrogen, A is divinylbenzene, and B is styrene.

8. The element of claim 5 wherein said mordant polymer is present at a concentration of about 5% to about 25% by weight of said top layer.

9. The element of claim 1 wherein said base layer is gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), or polyacrylamide or mixtures thereof.

10. The element of claim 1 wherein said base layer comprises gelatin.

11. The element of claim 1 wherein said base layer has a thickness of 3 to 20 $\mu$m and said top layer has a thickness of 0.1 to 2 $\mu$m.

12. The element of claim 1 wherein said base layer, said top layer or both include matte particles.

13. The element of claim 1 wherein said binder is methyl cellulose and hydroxyethyl cellulose.

14. The element of claim 13 wherein said hydroxyethyl cellulose is a cationically modified cellulose ether.

15. The element of claim 14 wherein said cationically modified cellulose ether is a hydroxyethyl cellulose reacted with trimethylammonium chloride substituted epoxide or hydroxyethyl cellulose reacted with a dodecyl dimethylammonium chloride substituted epoxide.

16. The element of claim 1 wherein said support is resin-coated paper.

17. An ink jet printing process comprising:

a) providing an ink jet recording element according to claim 1, and b) applying liquid ink droplets thereon in an image-wise manner.

* * * * *